US009508467B2

(12) United States Patent
Pon et al.

(10) Patent No.: US 9,508,467 B2
(45) Date of Patent: Nov. 29, 2016

(54) CABLE FOR INTEGRATED DATA TRANSMISSION AND POWER SUPPLY

(71) Applicant: YFC-BONEAGLE Electric Co., Ltd., Taoyuan (TW)

(72) Inventors: Wen-Fu Pon, Taoyuan (TW); Ying-Ming Ku, Taoyuan (TW)

(73) Assignee: YFC-BONEAGLE ELECTRIC CO., LTD., Taoyuan (TW)

( * ) Notice: Subject to any disclaimer, the term of this patent is extended or adjusted under 35 U.S.C. 154(b) by 49 days.

(21) Appl. No.: 14/611,032

(22) Filed: Jan. 30, 2015

(65) Prior Publication Data

US 2016/0225488 A1 Aug. 4, 2016

(51) Int. Cl.
*H01B 7/00* (2006.01)
*H01B 9/00* (2006.01)

(52) U.S. Cl.
CPC ..... *H01B 9/003* (2013.01)

(58) Field of Classification Search
CPC ..... H01B 9/003; H01B 9/006; H01B 9/02; H01B 11/002; H01B 11/06
USPC ..... 174/102 R, 108, 106 R, 110 R, 113 R, 174/113 C
See application file for complete search history.

(56) References Cited

U.S. PATENT DOCUMENTS 6,452,107 B1 * 9/2002 Kebabjian ..... H01B 11/002 174/113 R
6,534,716 B1 * 3/2003 Linnell ..... H01B 11/22 174/113 C
6,674,010 B2 * 1/2004 Inui ..... H01B 11/06 174/113 C
7,304,241 B2 * 12/2007 Trieb ..... H01R 9/032 174/74 R
8,039,749 B2 * 10/2011 Okano ..... H01B 11/1008 174/113 R
8,859,902 B2 * 10/2014 Matsuda ..... H01B 11/002 174/102 R
2003/0121694 A1 * 7/2003 Grogl ..... H01B 3/441 174/113 R
2004/0262027 A1 * 12/2004 Kaczmarski ..... H01B 7/187 174/113 R
2005/0061536 A1 * 3/2005 Proulx ..... G06Q 10/08 174/102 R
2010/0051318 A1 * 3/2010 Wang ..... H01B 11/12 174/113 R
2010/0084157 A1 * 4/2010 Wang ..... H01B 11/12 174/107
2011/0162866 A1 * 7/2011 Masakazu ..... H01B 11/002 174/103

FOREIGN PATENT DOCUMENTS

WO WO 2010/144314 A1 * 12/2010

* cited by examiner

*Primary Examiner* — William H Mayo, III
(74) *Attorney, Agent, or Firm* — HDLS IPR Services; Chun-Ming Shih

(57) ABSTRACT

A cable for integrated data transmission and power supply includes an insulative tube having a hollow chamber; an outer knitted shield disposed on an inner wall surface of the insulative tube; a first signal wire arranged inside the hollow chamber and including a plurality of first signal core lines and an inner knitted shield covering an outer thereof; a second signal wire penetrating through the hollow chamber and using the first signal wire as a center to be arranged at one side of the first signal wire; and a power wire penetrating through the hollow chamber and using the first signal wire as a center to be arranged at another side of the first signal wire and opposite from the second signal wire.

9 Claims, 1 Drawing Sheet

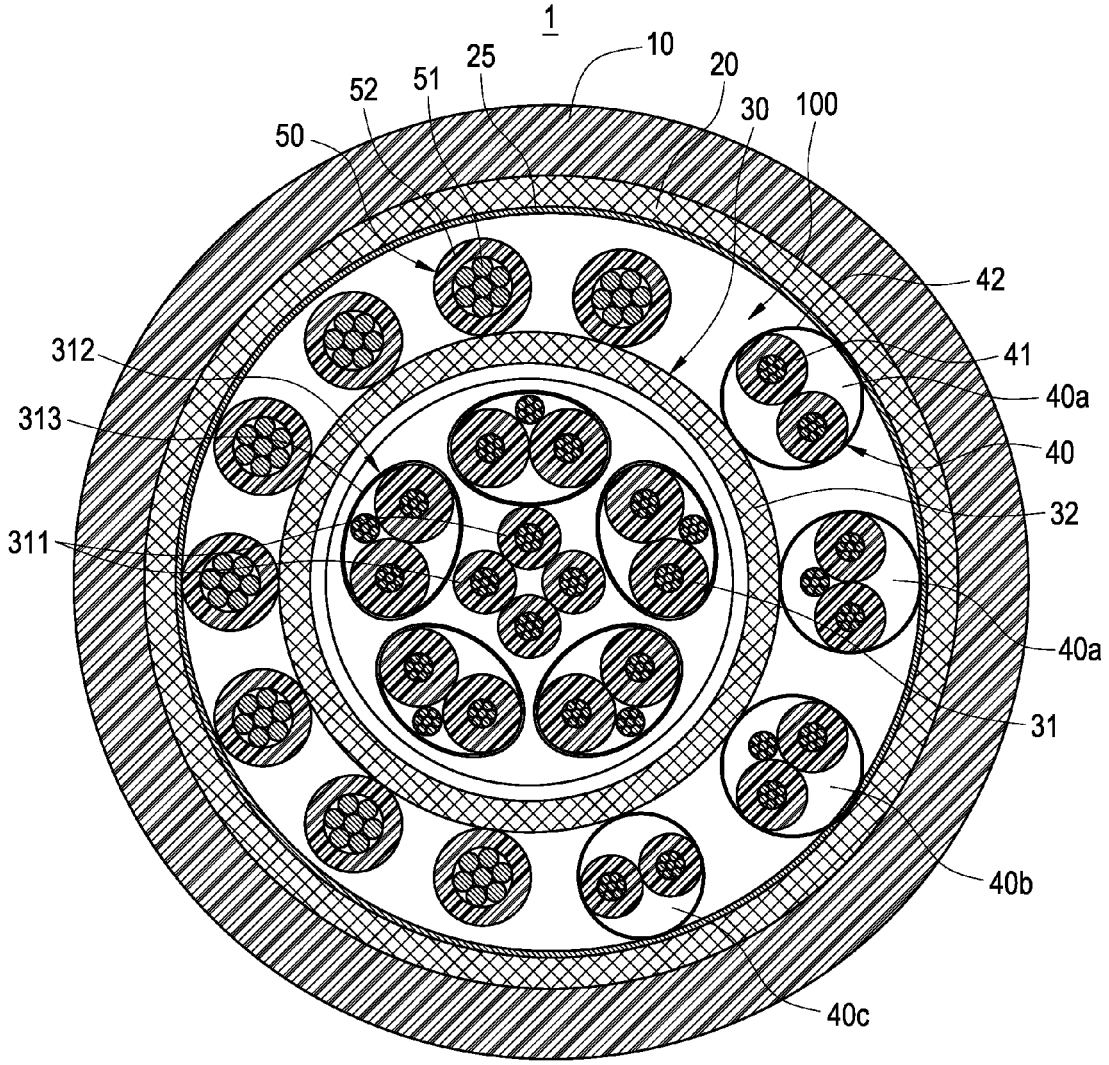
1
10
25
20
52
51
30
100
50
42
41
312
40a
313
40
32
311
40a
31
40b
40c

CABLE FOR INTEGRATED DATA TRANSMISSION AND POWER SUPPLY

BACKGROUND OF THE INVENTION

Field of the Invention

The present invention is related to a cable, in particular, to a cable for integrated data transmission and power supply.

Description of Related Art

Traditional cables can be categorized into High Definition Multimedia Interface (HDMI) transmission cables for HDMI transmission interfaces, Universal Serial Bus (USB) transmission cables for USB transmission interfaces and Power Cables for power supply interface and so on. In general, different transmission interface requires the use of a specific cable in order to provide different functions.

Furthermore, most of the visual devices, such as camera and so on, all rely on the image data and the power supply; therefore, most of the visual devices typically require the use of multiple cables including the data transmission cable for transmitting the image data and the power cable. As a result, the user needs to spend more time on the installation and maintenance of the cables. In addition, the malfunctioning rate of the cable would also increase as well, causing the cost to increase. Furthermore, as the visual devices advance from the analogue devices to digital cameras, in the modern development demanding efficiency, the issues relate to having simplified installations for cables with reduced cable sizes along with the reduction of cost at the same time are crucial problems to be solved in the application of visual devices.

In view of the above, the inventor seeks to overcome the problems associated with the currently existing technique after years of research and development along with the utilization of theoretical principles, and it is an objective of the inventor to provide a reasonable design and an improvement capable of effectively solve the aforementioned problems.

SUMMARY OF THE INVENTION

An objective of the present invention is to provide a cable for integrated data transmission and power supply in order to be adaptively used in a multiple types of different transmission interfaces.

Another objective of the present invention is to provide a cable for integrated data transmission and power supply in order to reduce the overall cable diameter of the cable such that it is able to not only reduce the size and save the material used but also maintain the protective characteristic as it is supposed to be.

To achieve the aforementioned objective, the present invention provides a cable for integrated data transmission and power supply, comprising an insulative tube, an outer knitted shield, a first signal wire, at least one second signal wire and at least one power signal wire. The insulative tube includes a hollow chamber; the outer knitted shield is disposed on an inner wall surface of the insulative tube; the first signal wire is arranged inside the hollow chamber; the first signal wire comprising a plurality of first signal core lines and an inner knitted shield covering an outer of the plurality of first signal core lines; the second signal wire penetrates through the hollow chamber; the second signal wire uses the first signal wire as a center in order to be arranged at one side of the first signal wire; and the power wire penetrates through the hollow chamber; the power wire uses the first signal wire as a center in order to be arranged at another side of the first signal wire and opposite from the second signal wire.

In comparison to the known cable structure, the cable of the present invention can be provided for various types of transmission interfaces at the same time, such as the high frequency signal multimedia transmission, high digital transmission and power supply and so on in order to overcome the problem associated with the traditional cables requiring the installation of individual cable according to the purpose of usage thereof separately. Furthermore, the cable of present invention provides the knitted shield only at the outer perimeter of the first signal wire and the inner wall of the insulative tube in addition to that the second signal wire and the power wire are arranged to circumference the outer perimeter of the first signal wire; therefore, it is able to reduce the overall cable diameter of the cable such that not only the size is reduced and material is saved but also maintaining the protective characteristic as it is supposed to be. As a result, it is able to satisfy the need of the user and increase the practical usages of the present invention.

BRIEF DESCRIPTION OF DRAWING

FIG. 1 is a cross sectional view of a cable for integrated data transmission and power supply of the present invention.

DETAILED DESCRIPTION OF THE INVENTION

The following provides a detailed description and technical content of the present invention along with the accompanied drawings. However, the accompanied drawings are provided for illustrative purposes only, which shall not be treated as limitations of the present invention.

Please refer to FIG. 1, showing a cross sectional view of a cable for integrated data transmission and power supply of the present invention. The cable 1 for integrated data transmission and power supply of the present invention integrates various types of different cables such that it can be adaptively used in various types of different transmission interfaces. The cable 1 comprises an insulative tube 10, an outer knitted shield 20, a first signal wire 30, at least one second signal wire 40 and at least one power wire 50. The insulative tube 10 encloses the outer knitted shield 20, the first signal wire 30, the second signal wire 40 and the power wire 50. The following provides a detailed description on the internal structure of the cable 1.

The insulative tube 10 is a hollow tubular body and includes a hollow chamber 10. The outer knitted shield 20 is, preferably, a metal mesh; the outer knitted shield 20 is disposed at an inner wall surface of the insulative tube 10.

In one embodiment of the present invention, the cable 1 further comprises an outer layer foil 25. The outer layer foil 25 is attached to an inner wall surface of the outer knitted shield 20. The arrangement of the outer knitted shield 20 and the outer layer foil 25 both can increase the effect of the shielding against the Electromagnetic Disturbance Interference (EMI) of the cable 1.

The first signal wire 30 is arranged inside the hollow chamber 100. The first signal wire 30 comprises a plurality of first signal core lines 31 and an inner knitted shield 32 covering an outer of the plurality of first signal core lines 31; preferably, the inner knitted shield 32 is a metal mesh. To be more specific, the plurality of first signal core lines 31 comprise at least one pair of inner twisted lines 311 and a plurality pairs of outer twisted lines 312 circumferencing an outer of the pair of inner twisted lines 311, and the plurality pairs of outer twisted lines 312 are covered by an inner insulative layer 313 respectively. In this embodiment, the plurality of first signal core lines 31 comprise two pairs of inner twisted lines 311 and four pairs of outer twisted lines 312; however, the actual embodiment is not limited to such configuration only.

Furthermore, the second signal line 40 penetrates through the hollow chamber 100. The second signal wire 40 uses the first signal wire 30 as a center in order to be arranged at one side of the first signal line 30. In this embodiment, the second signal wire 40 comprises a plurality of second signal core lines 41 and an inner layer foil 42 covering an outer of the plurality of second signal core lines 41. In addition, a quantity of the second signal wire 40 is plural, and the plurality of second signal wires 40 are arranged to circumference at one side of the first signal wire 30. To be more specific, the plurality of second signal wires 40 comprise two shielded twisted pairs (STP) 40*a*, an unshielded twisted pair (UTP) 40*b* and a pair of power core lines 40*c*; however, the actual embodiment is not limited such configuration only.

The power wire 50 penetrates through the hollow chamber 100, and the power wire 50 uses the first signal wire 30 as a center in order to be arranged at another side of the first signal wire 30 and opposite from the second signal wire 40. In this embodiment, the power wire 50 comprises a plurality of power supply core lines 51 and an insulative layer 52 covering an outer of the plurality of power supply core lines 51. In addition, a quantity of the power wire 50 is plural, and the plurality of power wires 50 are arranged to circumference at another side of the first signal wire 30 and opposite from the second signal wire 40.

In one embodiment of the present invention, the first signal wire 30 is a High Definition Multimedia Interface (HDMI) transmission wire for a transmission interface. In addition, the second signal wire 40 is a Universal Serial Bus (USB) transmission wire for a transmission interface; preferably, the second signal wire 40 is a USB 3.0 transmission wire.

Accordingly, once the cable 1 is completely assembled according to the aforementioned structure, it can be provided for the high frequency signal multimedia transmission (via the high definition multimedia interface) and the high digital transmission (via the universal serial bus interface) while being provided for the power supply at the same time.

In comparison to the known cable with parallel structure, the present invention provides the knitted shield only at the outer perimeter of the first signal wire 30 and the inner wall of the insulative tube in addition to that the second signal wire 40 and the power wire 50 are arranged to circumference the outer perimeter of the first signal wire 30; therefore, it is able to reduce the overall cable diameter of the cable 1 such that not only the size is reduced and material is saved but also maintaining the protective characteristic as it is supposed to be. As a result, it is able to satisfy the need of the user and increase the practical usages of the present invention.

In view of the above, it shall be noted that the above description provides preferred embodiments of the present invention only, which shall not be treated as limitation of the scope of the present invention. Any equivalent techniques and technical modifications based on the content of the specification and drawings of the present invention shall be deemed to be within the scope of the present invention.

What is claimed is:

1. A cable for integrated data transmission and power supply, comprising:

an insulative tube having a hollow chamber;

an outer knitted shield disposed on an inner wall surface of the insulative tube;

a first signal wire arranged inside the hollow chamber; the first signal wire comprising a plurality of first signal core lines, a plurality of inner twisted lines, and an inner knitted shield covering an outer of the plurality of first signal core lines, wherein the first signal wire is a high definition multimedia interface transmission wire for a transmission interface;

at least one second signal wire penetrating through the hollow chamber; the second signal wire using the first signal wire as a center in order to be arranged at one side of the first signal wire, wherein the second signal wire is a universal serial bus transmission wire for a transmission interface; and a plurality of power wires penetrating through the hollow chamber; the plurality of power wires surrounding and being arranged at another side of the first signal wire and opposite from the second signal wire, wherein the plurality of first signal core lines have different specification as the plurality of inner twisted lines, each of the plurality of first signal core lines has two outer twisted wires and one unshielded wire, and each of the plurality of first signal core lines is covered by an inner insulative layer, and wherein the plurality of inner twisted lines are surrounded by the plurality of first signal core lines.

2. The cable for integrated data transmission and power supply according to claim 1, further comprising an outer layer foil; the outer layer foil is attached to an inner wall surface of the outer knitted shield.

3. The cable for integrated data transmission and power supply according to claim 1, wherein the outer knitted shield is a metal mesh.

4. The cable for integrated data transmission and power supply according to claim 1, wherein the inner knitted shield is a metal mesh.

5. The cable for integrated data transmission and power supply according to claim 4, wherein the second signal wire is a USB 3.0 transmission wire.

6. The cable for integrated data transmission and power supply according to claim 1, wherein a quantity of the second signal wire is plural; the plurality of second signal wires are arranged to circumference at one side of the first signal wire.

7. The cable for integrated data transmission and power supply according to claim 6, wherein the plurality of second signal wires comprise two shielded twisted pairs, an unshielded twisted pair and a pair of power core lines.

8. The cable for integrated data transmission and power supply according to claim 1, wherein the second signal wire comprises a plurality of second signal core wires and an inner layer foil covering an outer of the plurality of second signal wires.

9. The cable for integrated data transmission and power supply according to claim 1, wherein the power wire comprises a plurality of power supply core lines and an insulative layer covering an outer of the plurality of power supply core lines.

* * * * *